US011566429B1

(12) United States Patent
Rosas

(10) Patent No.: US 11,566,429 B1
(45) Date of Patent: Jan. 31, 2023

(54) FASCIA BOARD INSTALLATION ACCESSORY AND ASSOCIATED USE THEREOF

(71) Applicant: Miguel Rosas, Long Beach, CA (US)

(72) Inventor: Miguel Rosas, Long Beach, CA (US)

( * ) Notice: Subject to any disclaimer, the term of this patent is extended or adjusted under 35 U.S.C. 154(b) by 447 days.

(21) Appl. No.: 16/732,330

(22) Filed: Jan. 1, 2020

Related U.S. Application Data

(60) Provisional application No. 62/754,168, filed on Nov. 1, 2018.

(51) Int. Cl.
*E04D 13/158* (2006.01)
*E04D 15/04* (2006.01)
*E04D 13/17* (2006.01)

(52) U.S. Cl.
CPC ..... *E04D 15/04* (2013.01); *E04D 13/158* (2013.01); *E04D 13/178* (2013.01); *E04D 2015/042* (2013.01)

(58) Field of Classification Search
CPC ..... E04D 15/04; E04D 13/158; E04D 13/178; E04D 2015/042; E04B 1/2612
See application file for complete search history.

(56) References Cited

U.S. PATENT DOCUMENTS 5,192,059 A * 3/1993 Silver ..... E04D 13/158 269/45
5,836,131 A * 11/1998 Viola ..... E04B 1/2612 52/715
6,209,280 B1 * 4/2001 Bruce ..... E04D 13/158 52/713
6,820,868 B1 * 11/2004 Reymus ..... E04F 21/1855 33/645
8,474,211 B1 * 7/2013 Washnock ..... E04D 12/00 52/543

* cited by examiner

*Primary Examiner* — Patrick J Maestri
(74) *Attorney, Agent, or Firm* — Ashkan Najafi

(57) ABSTRACT

A fascia board installation accessory includes a plurality of planar segments configured to form a substantially U-shaped configuration and is suitably sized and shaped to fit about a bottom edge of the existing fascia board, and an anchor segment extending outwardly away from the U-shaped configuration and directly abutted against one of an existing roof rafter and an existing roof lookout. The anchor segment is statically and integrally connected to the U-shaped configuration. The U-shaped configuration has a first centrally registered longitudinal axis. The anchor segment has a second centrally registered longitudinal axis oriented non-parallel to the first centrally registered longitudinal axis. The anchor segment has a plurality of apertures juxtaposed side-by-side and centrally aligned along the second centrally registered longitudinal axis.

17 Claims, 8 Drawing Sheets

FASCIA BOARD INSTALLATION ACCESSORY AND ASSOCIATED USE THEREOF

CROSS REFERENCE TO RELATED APPLICATIONS

This is a non-provisional patent application that claims the benefit of U.S. provisional patent application No. 62/754,168 filed Nov. 1, 2018, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to hand-held construction equipment and, more particularly, to an assistive tool including a fascia board installation accessory specially designed to help in the installation, repair, or replacement of fascia boards along the exterior of a building. Design intent is to provide both professionals and do-it-yourselfers with an accessory that facilitates completion of this task by a single individual by helping to keep the board in place, freeing up the user's hands so the necessary adjustments can be made, and the board nailed properly in place, without assistance.

Prior Art

Every day, thousands of professional contractors and amateur do-it-yourselfers embark on a variety of construction and home improvement tasks such as building an addition onto the home, replacing paneling or flooring and installing cupboards and countertops. Requiring varying degrees of skill, as well as a good eye, the results achieved by successfully completing these tasks can be enjoyed for years.

Regardless of whether one is a professional contractor, or simply a husband and wife duo making improvements to their living space, most would agree that the most important element in the completion of any of these tasks are tools. Hammers, chisels, saws and screwdrivers are but a few of the manual tools that are invaluable to anyone involved in construction or home improvement endeavor.

Accordingly, a need remains for a hand-held assistive tool in order to overcome at least one of the above-noted shortcomings. The exemplary embodiment(s) satisfy such a need by a fascia board installation accessory specially designed to help in the installation, repair, or replacement of fascia boards along the exterior of a building, that is convenient and easy to use, lightweight yet durable in design, versatile in its applications, and designed for providing both professionals and do-it-yourselfers with an accessory that facilitates completion of this task by a single individual by helping to keep the board in place, freeing up the user's hands so the necessary adjustments can be made, and the board nailed properly in place, without assistance.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a fascia board installation accessory specially designed to facilitate installation, repair, or replacement of an existing fascia board along an exterior of a building. These and other objects, features, and advantages of the non-limiting exemplary embodiment(s) are provided by a fascia board installation accessory including a plurality of planar segments configured to form a substantially U-shaped configuration and is suitably sized and shaped to fit about a bottom edge of the existing fascia board, and an anchor segment extending outwardly away from the U-shaped configuration and directly abutted against one of an existing roof rafter and an existing roof lookout. Advantageously, the anchor segment is statically and integrally connected to the U-shaped configuration. Advantageously, the U-shaped configuration has a first centrally registered longitudinal axis. Advantageously, the anchor segment has a second centrally registered longitudinal axis oriented non-parallel to the first centrally registered longitudinal axis. Advantageously, anchor segment has a plurality of apertures juxtaposed side-by-side and centrally aligned along the second centrally registered longitudinal axis. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

In a non-limiting exemplary embodiment, the planar segments include a first planar segment having a substantially rectangular shape and a first longitudinal length, a second planar segment having a substantially rectangular shape and a second longitudinal length, and a third planar segment having a substantially rectangular shape and a third longitudinal length. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

In a non-limiting exemplary embodiment, the first longitudinal length is greater than the second longitudinal length and the third longitudinal length. Advantageously, the second longitudinal length is shorter than the first longitudinal length and the third longitudinal length. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

In a non-limiting exemplary embodiment, each of the first longitudinal length, and the third longitudinal length are oriented parallel to the centrally registered longitudinal axis.

Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

In a non-limiting exemplary embodiment, the second centrally registered longitudinal axis obliquely traverses the first centrally registered longitudinal axis. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

In a non-limiting exemplary embodiment, the second centrally registered longitudinal axis orthogonally traverses the first centrally registered longitudinal axis. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

In a non-limiting exemplary embodiment, the anchor segment has one of a substantially rectangular shape and a substantially trapezoid shape and is fixedly and integrally coupled directly to the first planar segment, the anchor segment is spaced from second planar segment and the third planar segment. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

In a non-limiting exemplary embodiment, the anchor segment has smooth anterior and posterior faces. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

In a non-limiting exemplary embodiment, each of the first planar segment, the second planar segment, and the third planar segment has smooth anterior and posterior faces, respectively. Advantageously, the third planar segment has a topmost edge terminated at a height subjacent to a trajectory of the second centrally registered longitudinal axis. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

The present disclosure further includes a method of utilizing a fascia board installation accessory specially designed to facilitate installation, repair, or replacement of an existing fascia board along an exterior of a building. Such a method includes the initial steps of: providing a plurality of planar segments configured to form a substantially U-shaped configuration, wherein the planar segments have a first centrally registered longitudinal axis; and providing an anchor segment extending outwardly away from the U-shaped configuration, wherein the anchor segment is statically and integrally connected to the U-shaped configuration. Advantageously, the anchor segment has a second centrally registered longitudinal axis oriented non-parallel to the first centrally registered longitudinal axis. Such an anchor segment has a plurality of apertures juxtaposed side-by-side and centrally aligned along the second centrally registered longitudinal axis.

The method further includes the step of: fitting the U-shaped configuration about a bottom edge of the existing fascia board; directly abutting the anchor segment against one of an existing roof rafter and an existing roof lookout; and providing and inserting a plurality of fasteners through the apertures and the one of the existing roof rafter and an existing roof lookout. Such a structural configuration provides the new, useful, and unexpected result of enabling a single user to install, replace, or repair such awkwardly positioned fascia boards without having to rely on assistance from others. With the installation accessory in place, the user is then able to freely adjust and/or quickly nail the fascia board, without having to juggle hammer and nails with one hand while holding the fascia board with the other hand.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
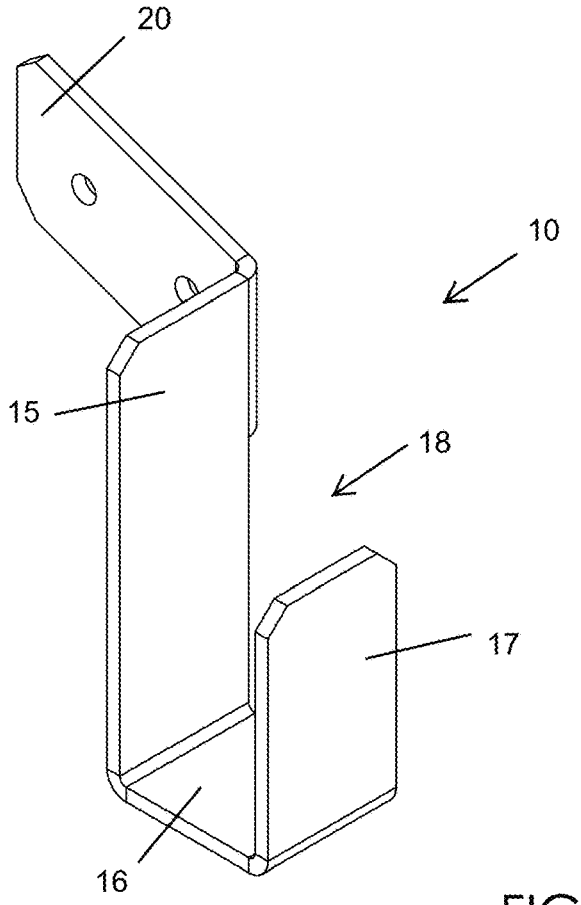
FIG. 1 is a perspective view of a fascia board installation accessory, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-16 and is/are intended to provide a fascia board installation accessory 10, 10' specially designed to help in the installation, repair, or replacement of fascia boards along an exterior of a building. The intent is to provide both professionals and do-it-yourselfers with an accessory 10, 10' that facilitates completion of this task by a single individual by helping to keep the fascia board 11 in place, freeing up the user's hands so the necessary adjustments can be made, and the fascia board 11 nailed properly in place, without assistance. It should be understood that the exemplary embodiment(s) may be used to install fascia boards 11 on a variety of building structures, and should not be limited to any particular building structure described herein.

Referring to FIGS. 1-16 in general, the fascia board installation accessory 10, 10' includes a plurality of planar segments 15, 16, 17 configured to form a substantially U-shaped configuration 18 suitably sized and shaped to fit about a bottom edge of an existing fascia board 11, and an anchor segment 20, 20' extending outwardly away from the U-shaped configuration 18 and directly abutted against one of an existing roof rafter 12 and an existing roof lookout 13. Advantageously, the anchor segment 20, 20' is statically and integrally connected to the U-shaped configuration 18. Advantageously, the U-shaped configuration 18 has a first centrally registered longitudinal axis 21. Advantageously, the anchor segment 20, 20' has a second centrally registered longitudinal axis 22 oriented non-parallel to the first centrally registered longitudinal axis 21. Advantageously, anchor segment 20, 20' has a plurality of apertures 23 juxtaposed side-by-side and centrally aligned along the second centrally registered longitudinal axis 22. Such a structural configuration provides the new, useful, and unexpected result of enabling a single user to install, replace, or repair such awkwardly positioned fascia boards 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

In a non-limiting exemplary embodiment, the planar segments 15, 16, 17 include a first planar segment 15 having a substantially rectangular shape and a first longitudinal length 15*d*, a second planar segment 16 having a substantially rectangular shape and a second longitudinal length 16*d*, and a third planar segment 17 having a substantially rectangular shape and a third longitudinal length 17*d*. Such a structural configuration provides the new, useful, and unexpected result of enabling a single user to install, replace, or repair such awkwardly positioned fascia boards 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

In a non-limiting exemplary embodiment, the first longitudinal length 15*d* is greater than the second longitudinal length 16*d* and the third longitudinal length 17*d*. Advantageously, the second longitudinal length 16*d* is shorter than the first longitudinal length 15*d* and the third longitudinal length 17*d*. Such a structural configuration provides the new, useful, and unexpected result of enabling a single user to install, replace, or repair such awkwardly positioned fascia board 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

In a non-limiting exemplary embodiment, each of the first longitudinal length 15*d*, and the third longitudinal length 17*d* are oriented parallel to the first centrally registered longitudinal axis 21. Such a structural configuration provides the new, useful, and unexpected result of enabling a single user to install, replace, or repair such awkwardly positioned fascia board 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

In a non-limiting exemplary embodiment, in FIG. 1, the second centrally registered longitudinal axis 22 obliquely traverses the first centrally registered longitudinal axis 21. Such a structural configuration provides the new, useful, and unexpected result of enabling a single user to install, replace, or repair such awkwardly positioned fascia boards 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

Figure 2:
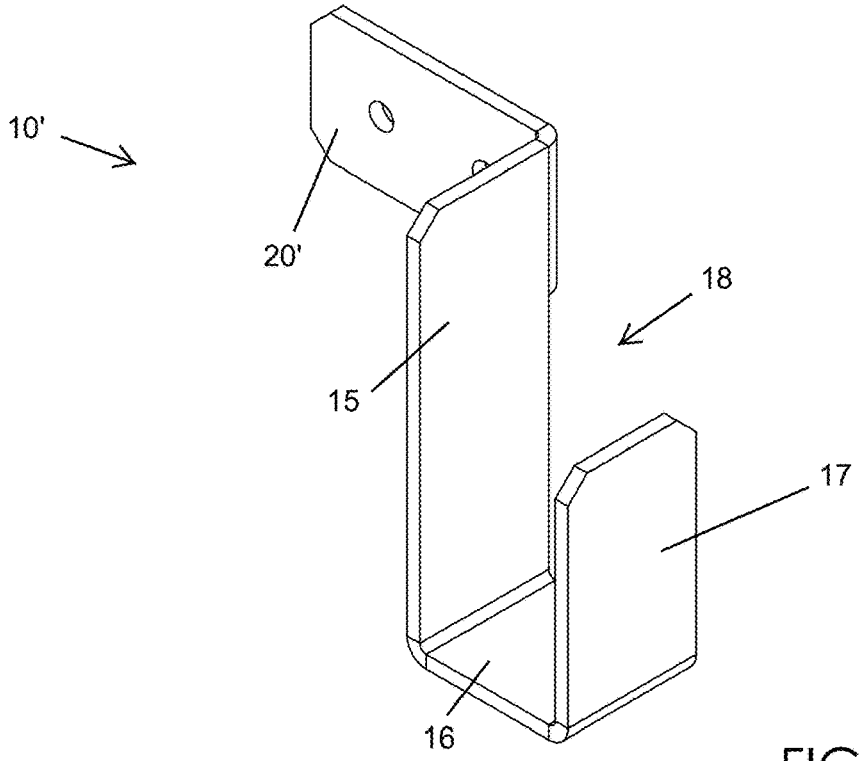
FIG. 2 is a perspective view of a fascia board installation accessory, in accordance with another non-limiting exemplary embodiment of the present disclosure.
Figure 3:
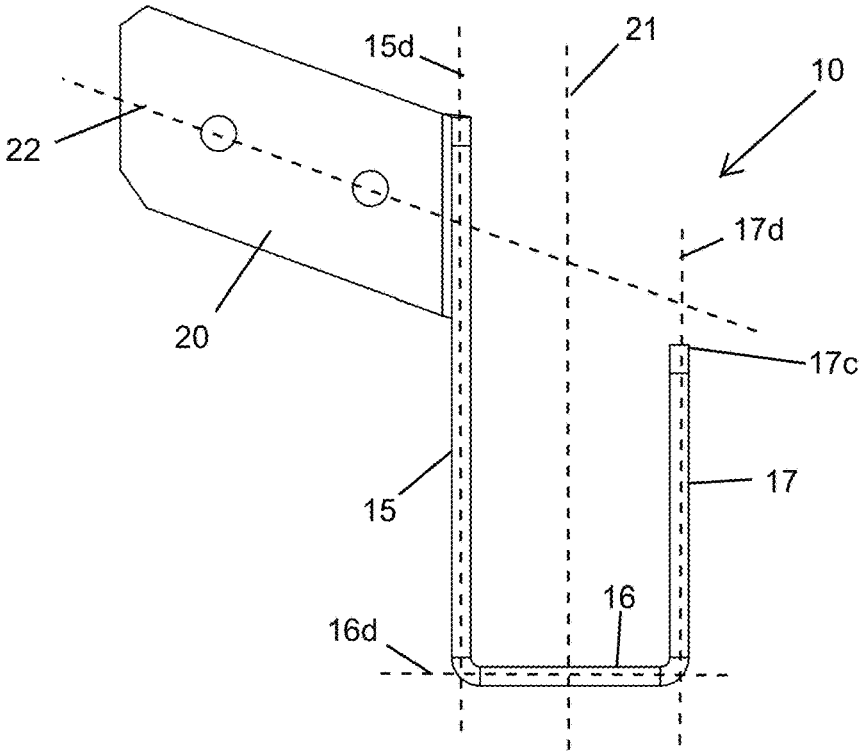
FIG. 3 is a front elevational view of the fascia board installation accessory shown in FIG. 1.
Figure 4:
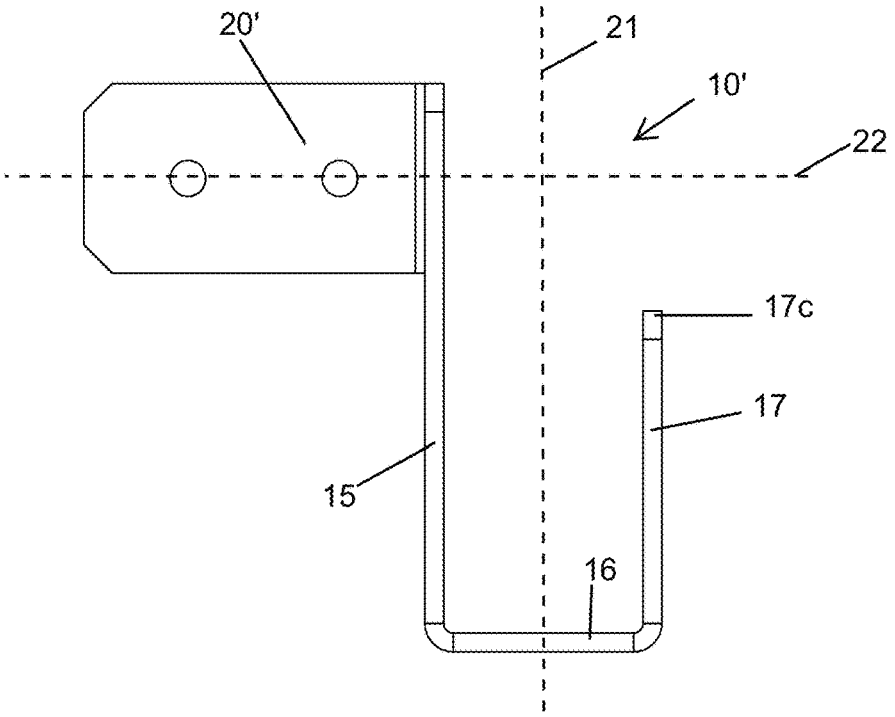
FIG. 4 is a front elevational view of the fascia board installation accessory shown in FIG. 2.
Figure 5:
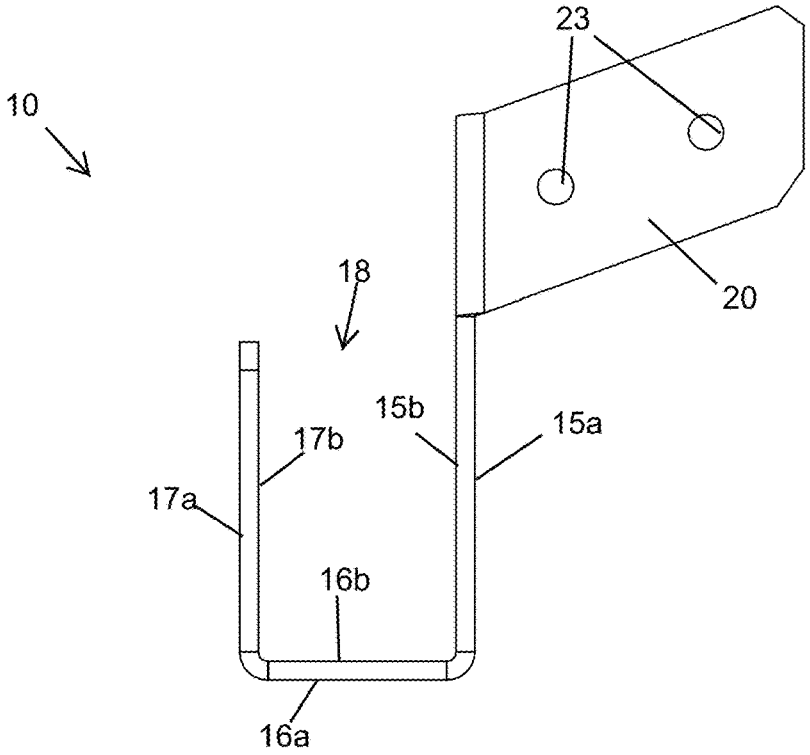
FIG. 5 is a rear elevational view of the fascia board installation accessory shown in FIG. 1.
Figure 6:
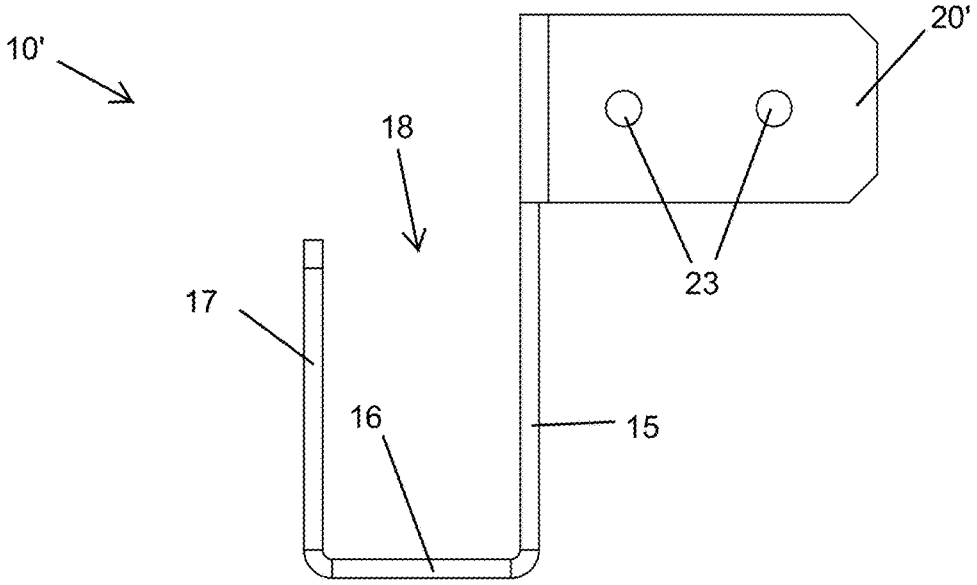
FIG. 6 is a rear elevational view of the fascia board installation accessory shown in FIG. 2.
Figure 7:
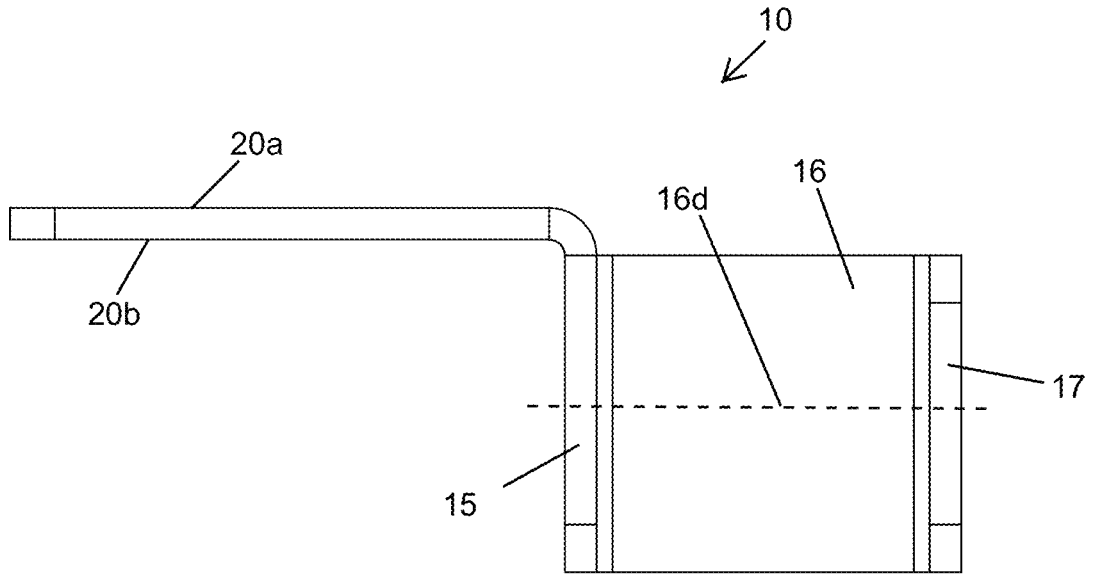
FIG. 7 is a top plan view of the fascia board installation accessory shown in FIG. 1.
Figure 8:
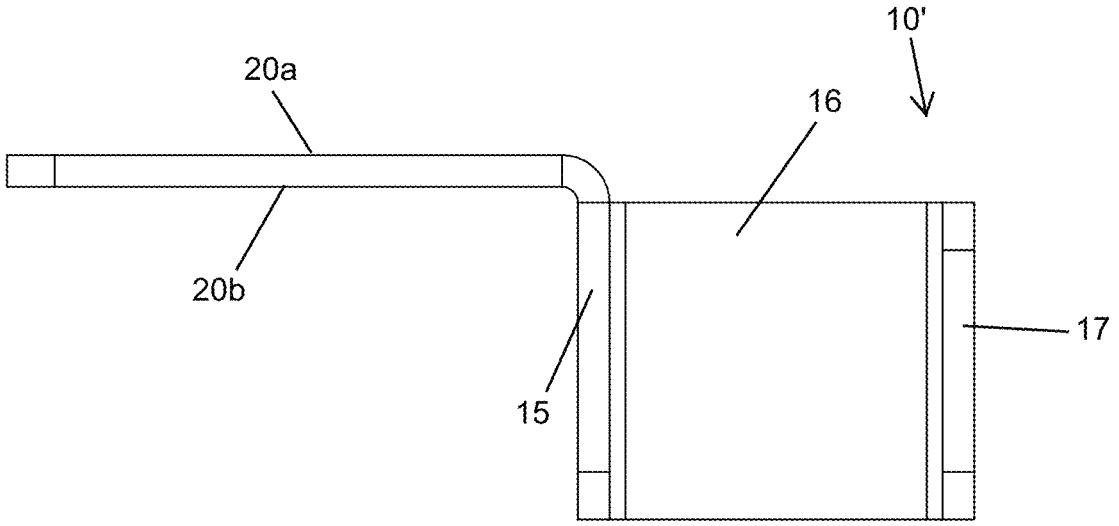
FIG. 8 is a top plan view of the fascia board installation accessory shown in FIG. 2.
Figure 9:
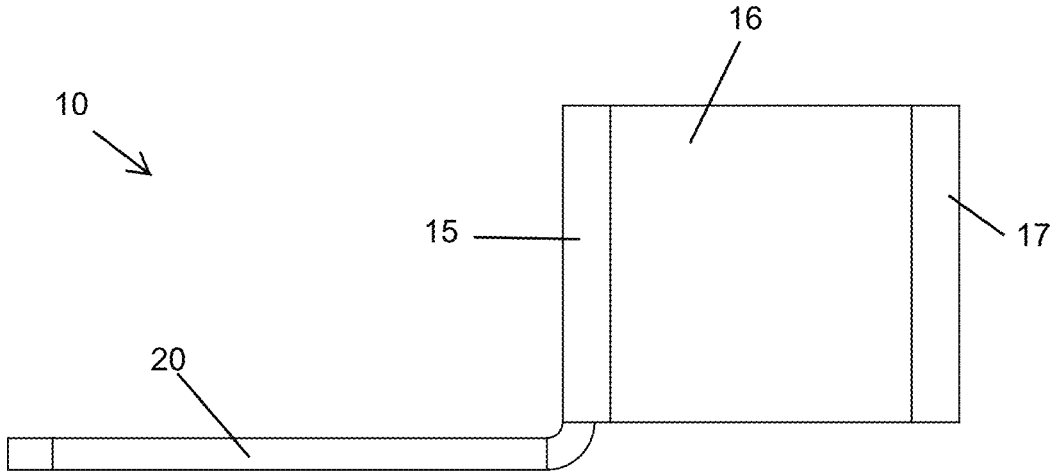
FIG. 9 is a bottom plan view of the fascia board installation accessory shown in FIG. 1.
Figure 10:
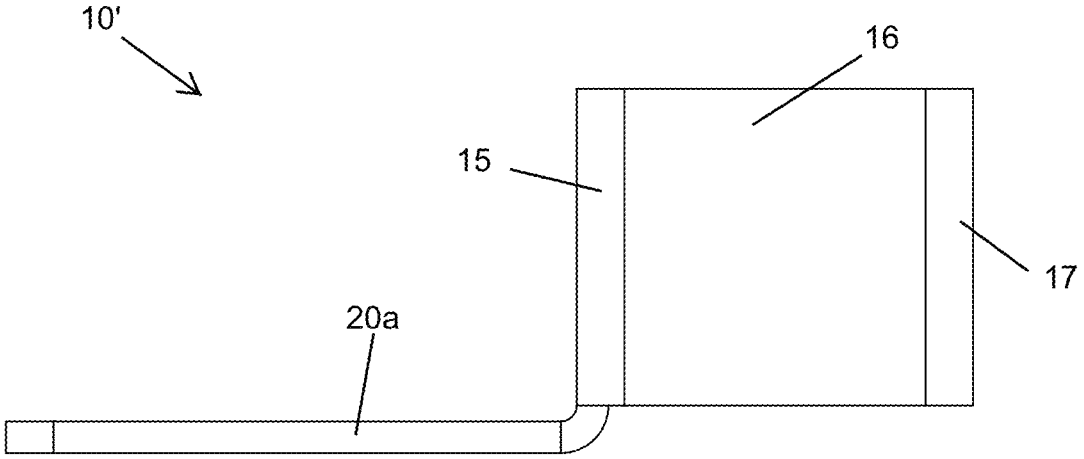
FIG. 10 is a bottom plan view of the fascia board installation accessory shown in FIG. 2.
Figure 11:
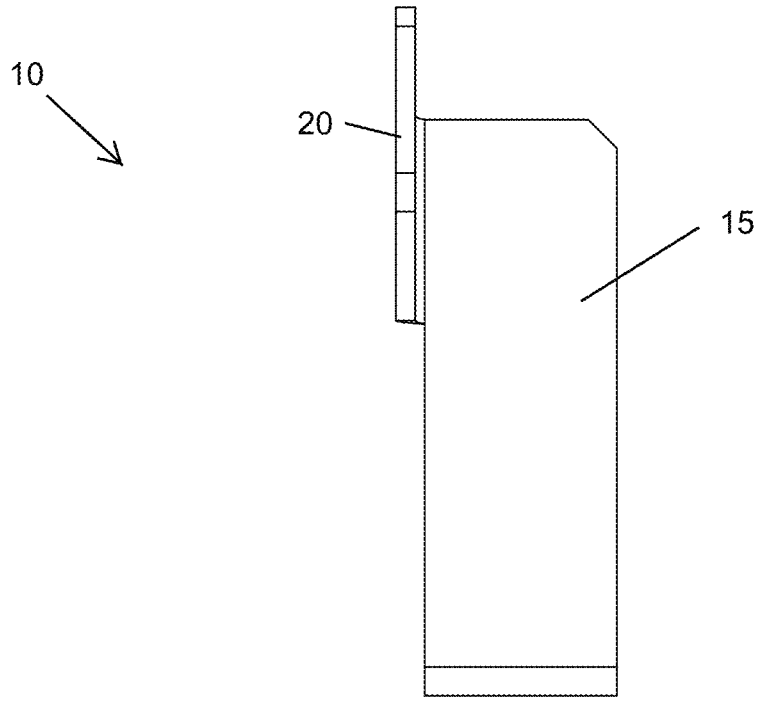
FIG. 11 is a left-side elevational view of the fascia board installation accessory shown in FIG. 1.
Figure 12:
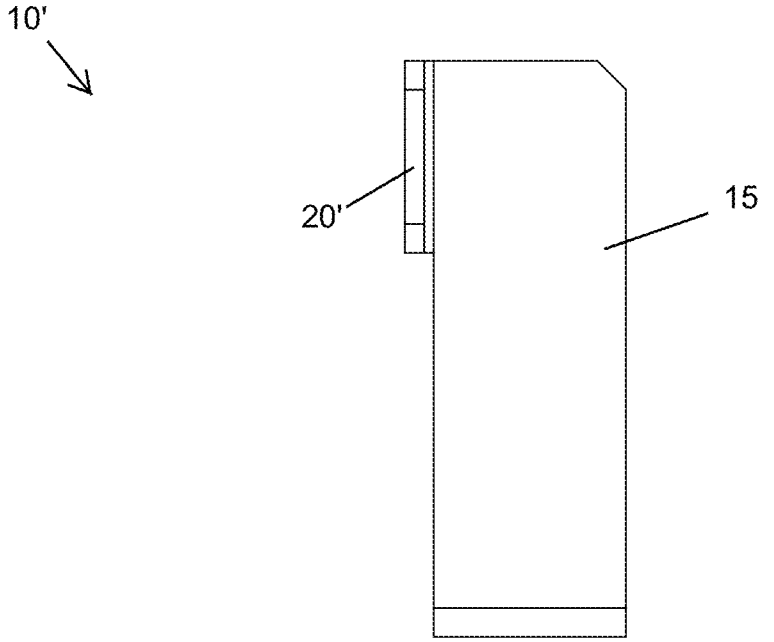
FIG. 12 is a left-side elevational view of the fascia board installation accessory shown in FIG. 2.
Figure 13:
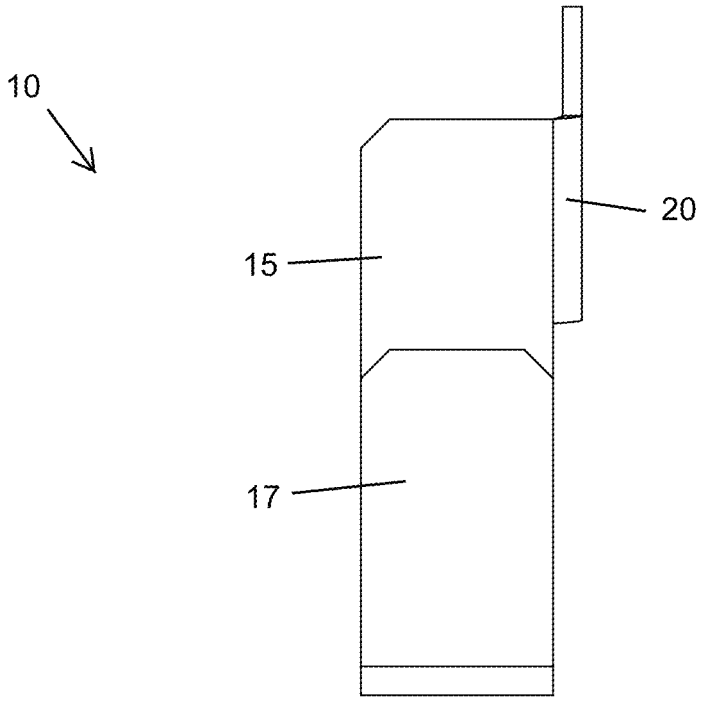
FIG. 13 is a right-side elevational view of the fascia board installation accessory shown in FIG. 1.
Figure 14:
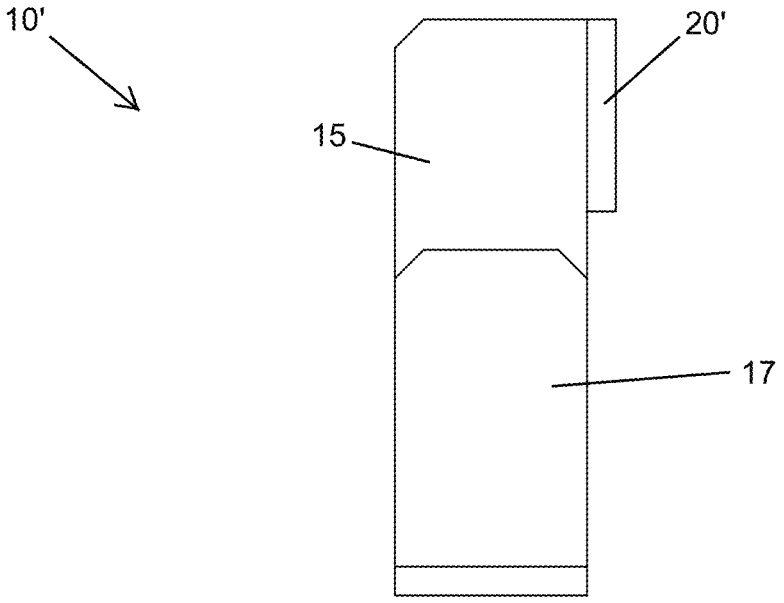
FIG. 14 is a right-side elevational view of the fascia board installation accessory shown in FIG. 2.
Figure 15:
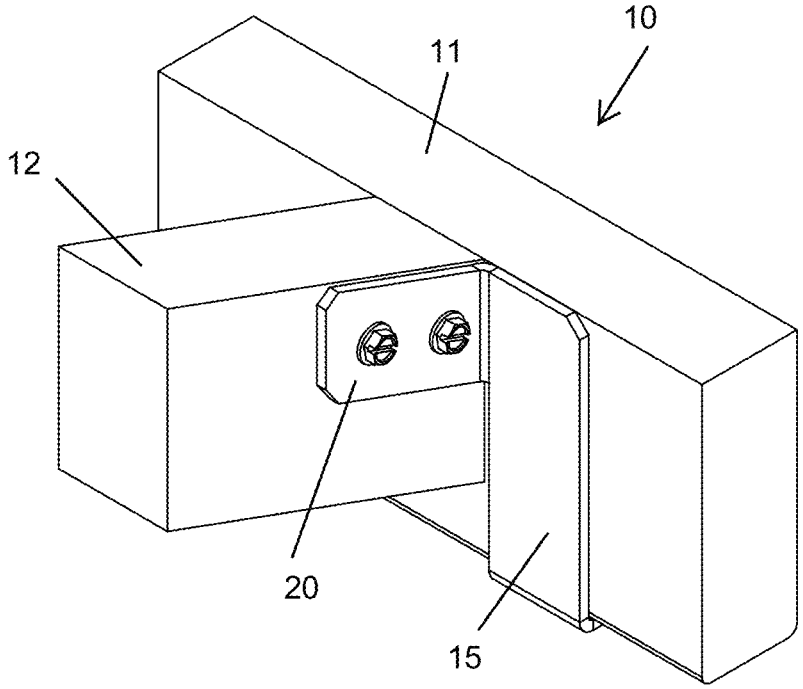
FIG. 15 is an environmental view of the fascia board installation accessory shown in FIG. 1, attached to an existing fascia board and an existing roof rafter.
Figure 16:
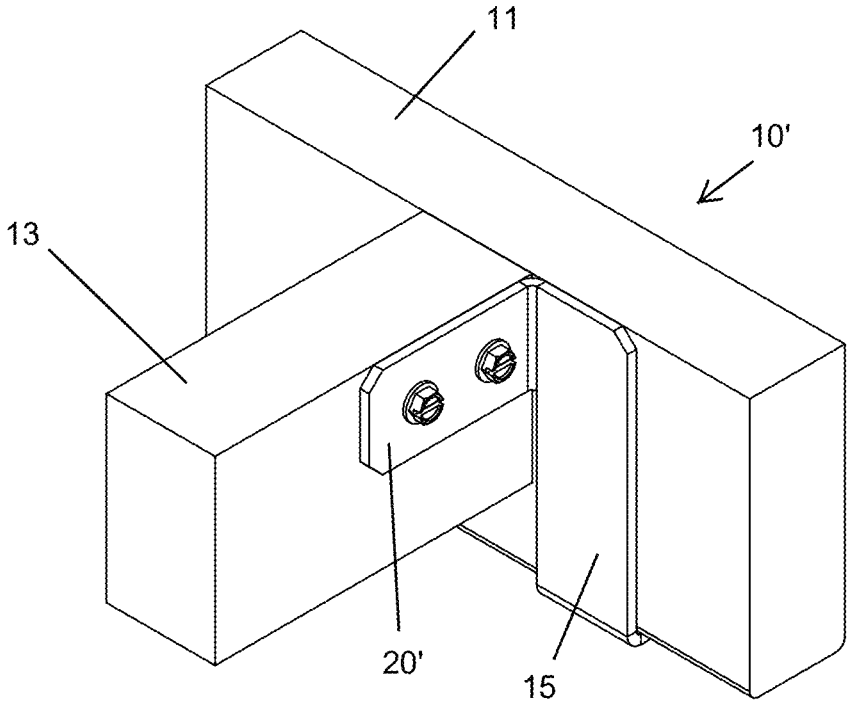
FIG. 16 is a right-side elevational view of the fascia board installation accessory shown in FIG. 2, attached to an existing roof lookout and an existing roof rafter.

In a non-limiting exemplary embodiment, in FIG. 2, the second centrally registered longitudinal axis 22 orthogonally traverses the first centrally registered longitudinal axis 21. Such a structural configuration provides the new, useful, and unexpected result of enabling a single user to install, replace, or repair such awkwardly positioned fascia board 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

In a non-limiting exemplary embodiment, the anchor segment 20, 20' has one of a substantially rectangular shape (see FIG. 2) and a substantially trapezoid shape (see FIG. 1) and is fixedly and integrally (monolithically) coupled directly to the first planar segment 15. Advantageously, anchor segment 20, 20' is spaced from second planar segment 16 and the third planar segment 17. Such a structural configuration provides the new, useful, and unexpected result of enabling a single user to install, replace, or repair such awkwardly positioned fascia board 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

In a non-limiting exemplary embodiment, the anchor segment 20, 20' has smooth anterior and posterior faces 20*a*, 20*b*, respectively. Such a structural configuration provides the new, useful, and unexpected result of enabling a single user to install, replace, or repair such awkwardly positioned fascia board 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

In a non-limiting exemplary embodiment, each of the first planar segment 15, the second planar segment 16, and the third planar segment 17 has smooth anterior and posterior faces 15*a*, 15*b*, and 16*a*, 16*b*, and 17*a*, 17*b*, respectively. Advantageously, the third planar segment 17 has a topmost edge 17*c* terminated at a height subjacent to a trajectory of the second centrally registered longitudinal axis 22. Such a structural configuration provides the new, useful, and unexpected result of enabling a single user to install, replace, or repair such awkwardly positioned fascia board 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

The present disclosure further includes a method of utilizing a fascia board installation accessory 10, 10' specially designed to facilitate installation, repair, or replacement of an existing fascia board 11 along an exterior of a building. Such a method includes the initial steps of: providing a plurality of planar segments 15, 16, 17 configured to form a substantially U-shaped configuration 18, wherein the planar segments 15, 16, 17 have a first centrally registered longitudinal axis 21; and providing an anchor segment 20, 20' extending outwardly away from the U-shaped configuration 18, wherein the anchor segment 20, 20' is statically and integrally (monolithically) connected to the U-shaped configuration 18. In this manner, the accessory 10, 10' can be formed from a single sheet of material. Advantageously, the anchor segment 20, 20' has a second centrally registered longitudinal axis 22 oriented non-parallel to the first centrally registered longitudinal axis 21. Such an anchor segment 20, 20' has a plurality of apertures 23 juxtaposed side-by-side and centrally aligned along the second centrally registered longitudinal axis 22.

The method further includes the steps of: fitting the U-shaped configuration 18 about a bottom edge of the existing fascia board 11; directly abutting the anchor segment 20, 20' against one of an existing roof rafter 12 and an existing roof lookout 13; and providing and inserting a plurality of fasteners (e.g., screws) through the apertures 23 and the one of the existing roof rafter 12 and an existing roof lookout 13. Such a structural configuration provides the new, useful, and unexpected result of enabling a single user to install, replace, or repair such awkwardly positioned fascia board 11 without having to rely on assistance from others. With the installation accessory 10, 10' in place, the user is then able to freely adjust and/or quickly nail the fascia board 11, without having to juggle hammer and nails with one hand while holding the fascia board 11 with the other hand.

Referring to FIGS. 1-16 in general, in a non-limiting exemplary embodiment(s), the fascia board installation accessory 10, 10' is an assistive tool that is specially designed to help in the installation, repair, or replacement of fascia board 11 along the exterior of a building. As such, the product allows both professionals and do-it-yourselfers to attend to these awkwardly positioned fascia boards 11 without having to rely on assistance from others. Fabricated of a durable aluminum or sturdy plastic material, the fascia board installation accessory 10, 10' may be offered as a two-part product: one would be used on the roof rafter 12 tail, while the companion may be affixed to the roof lookout 13. The former may feature an angled U-shape configuration, to better accommodate corners, and may measure approximately seven- and one-half inches (7½") in width with a one- and one-half inch (1½") open slot for fitting of the fascia board 11. This embodiment's bottom face may measure three- and one-half inches (3½") in length. The second piece of the fascia board 11 installation accessory 10, 10' may be similarly sized and shaped, yet may offer a straighter (orthogonal) configuration. Additionally, its bottom side may be slightly smaller, at three inches (3") in length.

Relatively simple in design yet extremely effective in application, use of the fascia board installation accessory 10, 10' is very easy and straightforward. First, a user connects the portions of the fascia board 11 installation accessory 10, 10' as described above, with the primary accessory 10 fitted onto the roof rafter 12 tail and the secondary accessory 10' affixed to the lookout 13. (The inventor states that while the system would work with only the primary component, it is recommended both be used for optimal effectiveness.) With both accessories 10, 10' in place, the user is then able to freely adjust and/or quickly nail the fascia board 11, without having to juggle hammer and nails with one hand while holding the board with the other.

The fascia board installation accessory 10, 10' is a unique product, which offers a number of significant benefits and advantages. Foremost, this innovative unit provide users with a simple, efficient means of attending to installation, repair, and maintenance tasks involving roof line fascia boards 11. Boasting a dual anchoring system, the fascia board installation accessory 10, 10' enables the user to effortlessly conquer any job at hand, without the need to wrestle with unwieldy boards by oneself or to depend on another person for assistance. Because of this important advantage, use of the fascia board installation accessory 10, 10' ensures that many jobs are completed in record time. As a result, this product is able to save both employers and clients significant money in labor costs, possibly into the thousands of dollars.

Users should appreciate that the fascia board installation accessory 10, 10' facilitates use of the tool in awkward vertical or horizontal positions, eliminating the need to laboriously and painfully contort the body for extended periods of time. Applied to and removed from fascia boards 11 in a matter of seconds, this compact and lightweight system could be easily kept in a toolbox, readily available whenever needed. Ideal for use by contractors and other professional trades-workers, this versatile accessory 10, 10' also proves an invaluable commodity to household do-it-yourselfer. Manufactured of heavy duty, high quality materials, the fascia board installation accessory 10, 10' will withstand years of repeated use.

The fascia board installation accessory 10, 10' is a practical and creative product, which may conceivably revolutionize the construction industry. Simple to operate, this cleverly designed product is a staple of any toolbox, always at the ready for anyone involved in construction or home improvement activities. Affordably priced, the fascia board installation accessory 10, 10' will be well-received by professionals as well as amateur do-it-yourselfers, an extremely sizable market potential.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A fascia board installation accessory specially designed to facilitate installation, repair, or replacement of an existing fascia board along an exterior of a building, said fascia board installation accessory comprising:

a plurality of planar segments configured to form a substantially U-shaped configuration and being suitably sized and shaped and further being configured to fit about a bottom edge of the existing fascia board; and an anchor segment extending outwardly away from said U-shaped configuration and being directly abutted against one of an existing roof rafter and an existing roof lookout;

wherein said anchor segment is statically and integrally connected to said U-shaped configuration;

wherein said U-shaped configuration has a first centrally registered longitudinal axis;

wherein said anchor segment has a second centrally registered longitudinal axis oriented non-parallel to the first centrally registered longitudinal axis;

wherein the second centrally registered longitudinal axis obliquely traverses the first centrally registered longitudinal axis.

2. The fascia board installation accessory of claim 1, wherein said planar segments comprise:

a first planar segment having a substantially rectangular shape and a first longitudinal length;

a second planar segment having a substantially rectangular shape and a second longitudinal length; and a third planar segment having a substantially rectangular shape and a third longitudinal length.

3. The fascia board installation accessory of claim 2, wherein said first longitudinal length is greater than said second longitudinal length and said third longitudinal length; wherein said second longitudinal length is shorter than said first longitudinal length and said third longitudinal length.

4. The fascia board installation accessory of claim 3, wherein each of said first longitudinal length and said third longitudinal length are oriented parallel to the centrally registered longitudinal axis.

5. The fascia board installation accessory of claim 1, wherein the second centrally registered longitudinal axis orthogonally traverses the first centrally registered longitudinal axis.

6. The fascia board installation accessory of claim 2, wherein said anchor segment has one of a substantially rectangular shape and a substantially trapezoid shape and is fixedly and integrally coupled directly to said first planar segment, said anchor segment being spaced from second planar segment and said third planar segment.

7. The fascia board installation accessory of claim 1, wherein said anchor segment has smooth anterior and posterior faces.

8. The fascia board installation accessory of claim 2, wherein each of said first planar segment, said second planar segment, and said third planar segment has smooth anterior and posterior faces, respectively;

wherein said third planar segment has a topmost edge terminated at a height subjacent to a trajectory of the second centrally registered longitudinal axis.

9. A fascia board installation accessory specially designed to facilitate installation, repair, or replacement of an existing fascia board along an exterior of a building, said fascia board installation accessory comprising:

a plurality of planar segments configured to form a substantially U-shaped configuration and being suitably sized and shaped and further being configured to fit about a bottom edge of the existing fascia board; and an anchor segment extending outwardly away from said U-shaped configuration and being directly abutted against one of an existing roof rafter and an existing roof lookout;

wherein said anchor segment is statically and integrally connected to said U-shaped configuration;

wherein said U-shaped configuration has a first centrally registered longitudinal axis;

wherein said anchor segment has a second centrally registered longitudinal axis oriented non-parallel to the first centrally registered longitudinal axis;

said anchor segment having a plurality of apertures juxtaposed side-by-side and centrally aligned along the second centrally registered longitudinal axis;

wherein the second centrally registered longitudinal axis obliquely traverses the first centrally registered longitudinal axis.

10. The fascia board installation accessory of claim 9, wherein said planar segments comprise:

a first planar segment having a substantially rectangular shape and a first longitudinal length;

a second planar segment having a substantially rectangular shape and a second longitudinal length; and a third planar segment having a substantially rectangular shape and a third longitudinal length.

11. The fascia board installation accessory of claim 10, wherein said first longitudinal length is greater than said second longitudinal length and said third longitudinal length; wherein said second longitudinal length is shorter than said first longitudinal length and said third longitudinal length.

12. The fascia board installation accessory of claim 11, wherein each of said first longitudinal length and said third longitudinal length are oriented parallel to the centrally registered longitudinal axis.

13. The fascia board installation accessory of claim 9, wherein the second centrally registered longitudinal axis orthogonally traverses the first centrally registered longitudinal axis.

14. The fascia board installation accessory of claim 10, wherein said anchor segment has one of a substantially rectangular shape and a substantially trapezoid shape and is fixedly and integrally coupled directly to said first planar segment, said anchor segment being spaced from second planar segment and said third planar segment.

15. The fascia board installation accessory of claim 9, wherein said anchor segment has smooth anterior and posterior faces.

16. The fascia board installation accessory of claim 10, wherein each of said first planar segment, said second planar segment, and said third planar segment has smooth anterior and posterior faces, respectively;

wherein said third planar segment has a topmost edge terminated at a height subjacent to a trajectory of the second centrally registered longitudinal axis.

17. A method of utilizing a fascia board installation accessory specially designed to facilitate installation, repair, or replacement of an existing fascia board along an exterior of a building, said method comprising the steps of:

providing a plurality of planar segments configured to form a substantially U-shaped configuration, said U-shaped configuration having a first centrally registered longitudinal axis;

providing an anchor segment extending outwardly away from said U-shaped configuration, said anchor segment being statically and integrally connected to said U-shaped configuration, said anchor segment having a second centrally registered longitudinal axis oriented non-parallel to the first centrally registered longitudinal axis, said anchor segment having a plurality of apertures juxtaposed side-by-side and centrally aligned along the second centrally registered longitudinal axis;

fitting said U-shaped configuration about a bottom edge of the existing fascia board;

directly abutting said anchor segment against one of an existing roof rafter and an existing roof lookout; and providing and inserting a plurality of fasteners through said apertures and the one of the existing roof rafter and an existing roof lookout.

* * * * *